US005557818A

United States Patent [19]

Leon

[11] Patent Number: 5,557,818

[45] Date of Patent: Sep. 24, 1996

[54] UTILITY PEN-KNIFE

[76] Inventor: Michael Leon, 1209 NE. 3rd St., Moore, Okla. 73160

[21] Appl. No.: 337,756

[22] Filed: Nov. 14, 1994

[51] Int. Cl.[6] ..... B26B 11/00

[52] U.S. Cl. ..... 7/160; 30/162

[58] Field of Search ..... 7/158, 160, 103, 7/105; 30/162, 164, 294, 123, 335, 332, 125

[56] References Cited

U.S. PATENT DOCUMENTS

| | | | |
|---|---|---|---|
| 1,444,155 | 2/1923 | Jorgensen | 7/160 |
| 3,660,895 | 5/1972 | West | 30/162 |
| 4,068,375 | 1/1978 | Rathbun et al. | 30/162 X |
| 4,602,397 | 7/1986 | Chao | 7/160 X |
| 4,635,309 | 1/1987 | Larsen | 30/162 X |
| 4,744,146 | 5/1988 | Schmidt | 30/162 |
| 4,805,304 | 2/1989 | Knoop | 30/162 |
| 4,891,881 | 1/1990 | Mills | 30/123 |
| 5,174,028 | 12/1992 | Seltzer, Jr. | 30/329 X |
| 5,315,760 | 5/1994 | Emerson | 7/160 X |

*Primary Examiner*—D. S. Meislin

[57] ABSTRACT

A utility pen-knife includes a hollow body having a partition wall, wherein one end of the pen body spaced from the partition wall includes a pen structure and a further portion of the body adjacent the partition wall includes an array of accessible replacement blade members, as well as a blade member reciprocatably mounted upon a carriage oriented for convenience of use.

5 Claims, 4 Drawing Sheets

UTILITY PEN-KNIFE

TECHNICAL FIELD

The field of invention relates to utility knife structure, and more particularly pertains to a new and improved utility pen-knife wherein the same is directed to permit a simplified and improved blade carrier arranged for ease of cutting in cooperation with a pen structure.

BACKGROUND OF THE INVENTION

A structure such as that structure having a generally hollow handle to retain a blade member therewithin is indicated in the U.S. Pat. No. 4,805,304, as well as U.S. Pat. Nos. 5,174,028 and 4,068,375, and further indicated in the U.S. Pat. No. 3,660,895.

The invention attempts to overcome the prior art by providing for an improved blade carrier structure, as well as the blade carrier having the convenience and orientation of a pen member positioned adjacent to the blade structure.

SUMMARY OF THE INVENTION

The present invention relates to a utility pen-knife wherein the same includes a hollow body having a partition wall, wherein one end of the pen body spaced from the partition wall includes a pen structure, wherein a further portion of the body adjacent the partition wall includes an array of accessible replacement blade members, as well as a blade member reciprocatably mounted upon a carriage oriented for convenience of use.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

Figure 1:
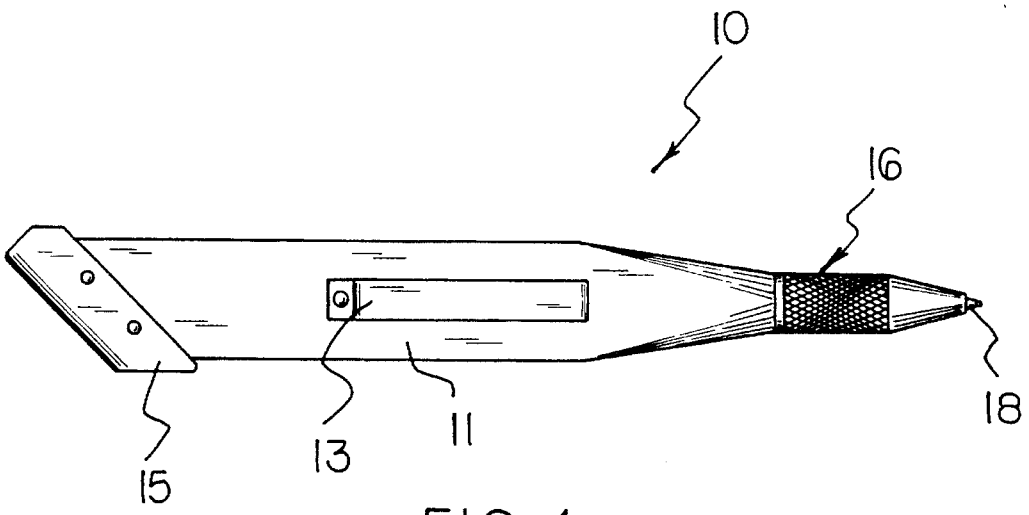
FIG. 1 is an orthographic bottom view of the invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The utility pen-knife 10 of the invention, as indicated in the FIGS. 1–8, includes a housing bottom wall 11 spaced from a housing top wall 12, such that a spring leg 13 is fixed at one end to the housing bottom wall 11 permitting ease of transport of the invention during periods of non-use such as by receiving the invention within a pocket of a garment and the like, and having the spring leg 13 clamped to that pocket flap between the spring leg 13 and the housing bottom wall 11. The housing is provided with a housing first end 14 spaced from a housing second end, such that the housing is longitudinally aligned and the housing first end has extending therefrom a shield 15 secured to the housing bottom wall 11 and projecting beyond the housing first end 14, with the housing first end (see FIG. 3) having a housing first end opening 35. In this manner, where a knife blade structure is to be described in more detail below, extends from the housing first end opening 35, the shield of an arcuate configuration canted beyond the housing bottom wall 11 provides for a concave surface for an individual to position an individual's thumb onto providing for an improved shield structure. A writing pen 16 is positioned within the housing and extends from the housing second end terminating in a writing tip 18, such that a partition wall 17 (see FIG. 8) demarcates the knife structure from the writing pen 16 within the housing. Relative to the writing pen 16, a fluid reservoir 19 is positioned within the housing and extends substantially from the partition wall 17 to the writing tip 18.

Figure 2:
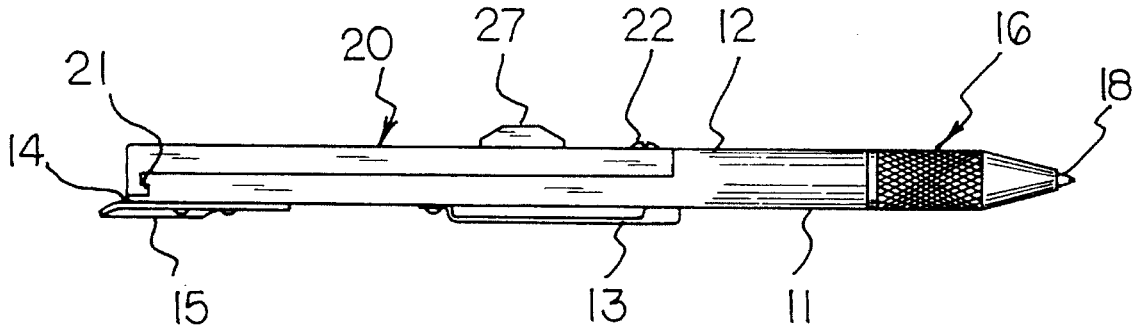
FIG. 2 is an orthographic side view of the invention.
Figure 3:
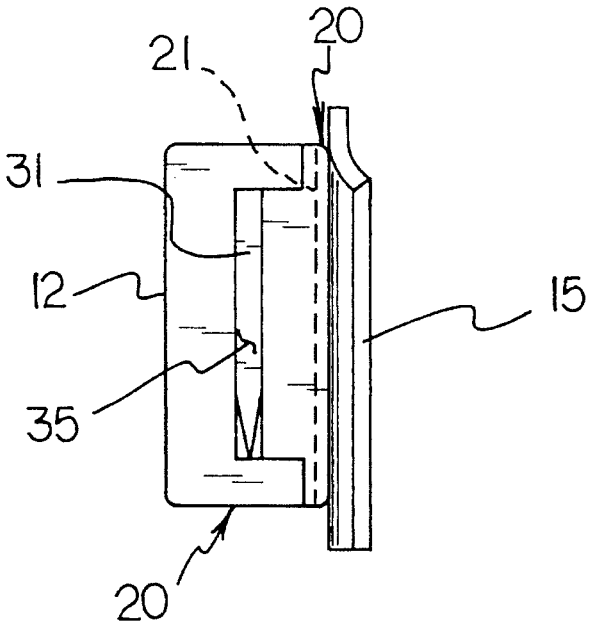
FIG. 3 is an orthographic view of the first end of the housing structure.
Figure 4:
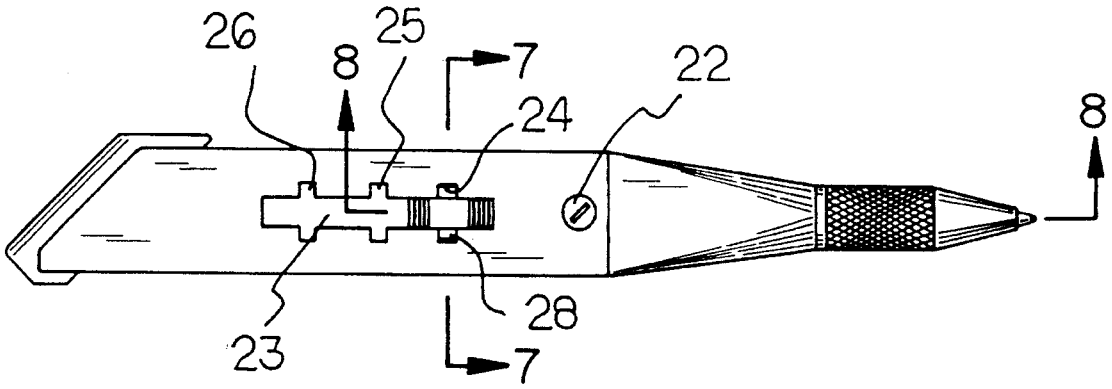
FIG. 4 is an orthographic top view of the invention.
Figure 5:
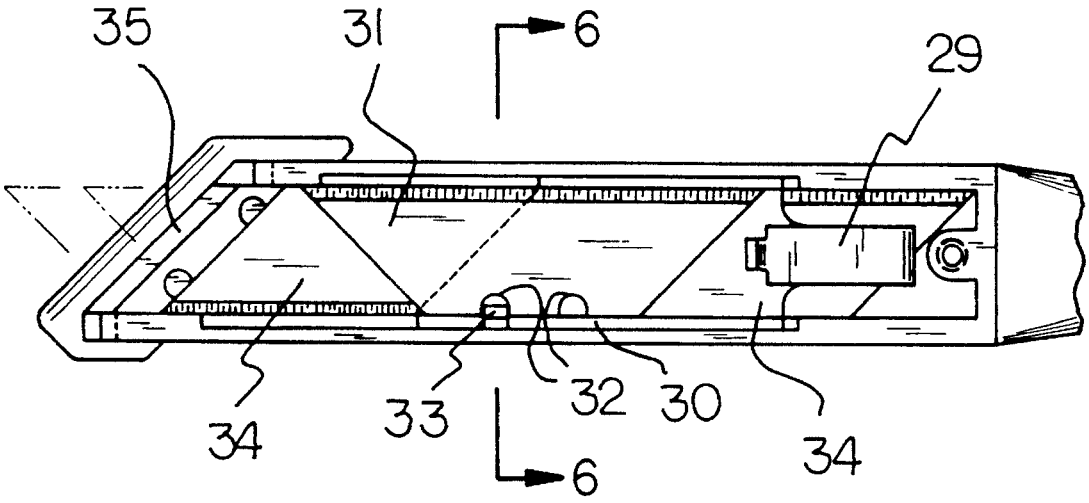
FIG. 5 is a partial orthographic view indicating the invention with the lid of the housing removed therefrom.
Figure 6:
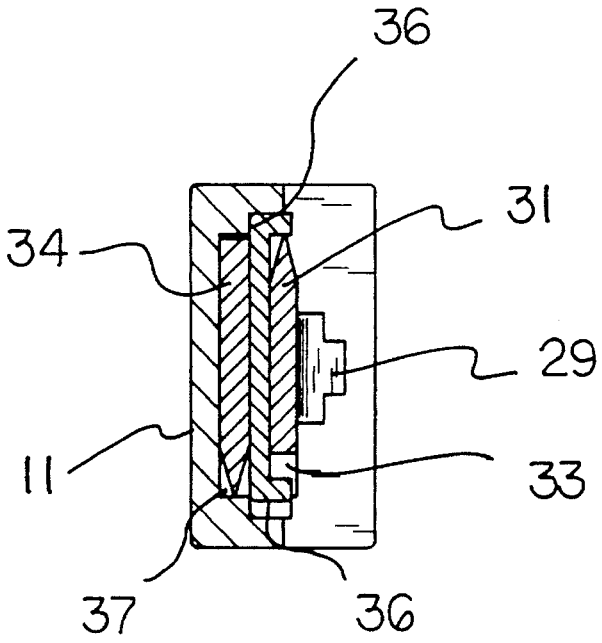
FIG. 6 is an orthographic view, taken along the lines 6—6 of FIG. 5 in the direction indicated by the arrows.
Figure 7:
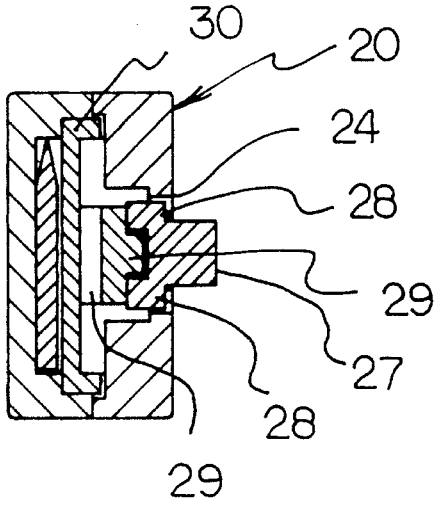
FIG. 7 is an orthographic view, taken along the lines 7—7 of FIG. 4 in the direction indicated by the arrows.

A cover lid 20 is removably mounted relative to the housing top wall 12 and is substantially coplanar therewith for a secured orientation relative to the housing, with the cover lid 20 having a cover lid first end rib 21 received within a housing first end recess, such as illustrated in FIG. 2, with the recess of the housing first end positioned in parallel adjacency relative to the housing first end opening 35. A lid fastener 22 is received through the lid and received within the partition wall 17 to thereby secure the cover lid to the housing when the first end rib 21 is received within the housing first end recess.

Figure 8:
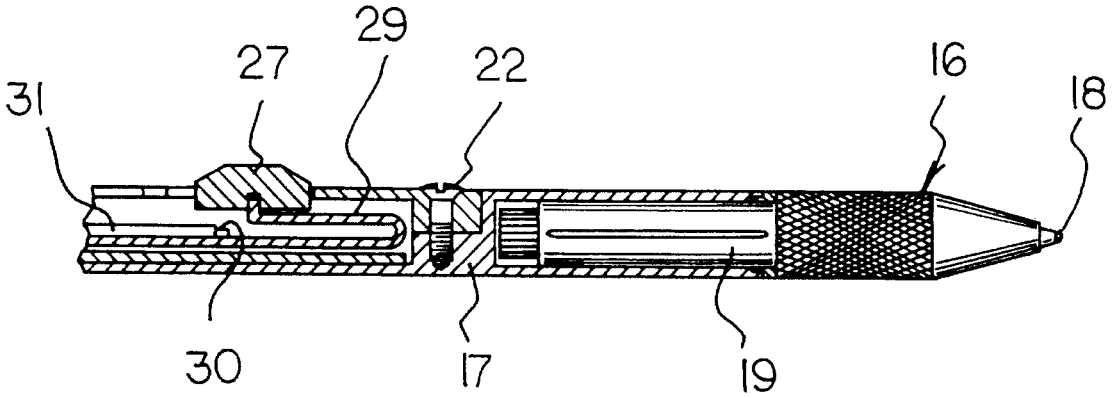
FIG. 8 is an orthographic view, taken along the lines 8—8, partially in section, as indicated in FIG. 4.

A primary slot 23 extends longitudinally and medially of the lid sides, such that respective first, second, and third intersecting slots 24, 25, and 26 intersect the primary slot 23, such that a locking lug 27 slidably received within the slot 23 includes locking lug shoulders 28, such that the shoulders 28 are selectively received within one of the intersecting slots 24, 25, and 26. The locking lug 27 is mounted upon a U-shaped spring 29 at the spring second end, with the spring first end secured to a carriage 30, in a manner such as indicated in FIG. 8, with the carriage 30 having a primary knife blade 31 positioned thereon. The carriage includes carriage side walls, such that one of the side walls includes a carriage lug 33 received within a side wall recess 32 of the primary knife blade 31 to position and secure the primary knife blade within the carriage structure, such that reciprocation of the carriage insures the knife blade to be transported therewith. To this end, the knife blade is provided with a predetermined width and such predetermined width is complementarily received within the carriage side walls and thereby orienting the knife blade upon the carriage floor, in a manner as indicated in the FIGS. 5 and 6 for example.

A row of secondary knife blades 34, such as three knife blades that are typically employed by the invention, are positioned within a row between the carriage and the housing bottom wall 11. To this end, the carriage is slidably mounted upon tracks 36 that are parallel relative to one another and extend laterally beyond the storage cavity housing the row of secondary knife blades 34. The storage cavity extends substantially from the housing first end 14 to the partition wall 17 to maximize storage capacity of the housing.

It is to be understood that while certain forms of the present invention have been illustrated and described herein, it is not to be limited to the specific forms or arrangement of parts described and shown. For example, the invention may be fabricated to rotate the shield 15 and the housing first end 14 in a manner to more readily accommodate left handed users of the device.

Further, the cutting blade may project beyond the shield 15 for light-duty severing employing the device as a utility knife.

Yet further, a light duty model of the device may be provided for household use.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A utility pen-knife, comprising, an elongate housing, said housing having a housing first end spaced from a housing second end, the housing longitudinally aligned to maintain ease of grasping and compactness relative to the housing, and wherein the housing first end includes a first end opening, and the housing having a bottom wall spaced from a top wall, with a housing lid selectively securable to the housing, with the housing lid arranged in a coplanar orientation relative to the top wall, and the housing lid is secured to the housing, and the housing having a partition wall within the housing, with a pen assembly terminating in a pen tip extending beyond the housing second end extending from the partition wall through the housing second end, and a knife assembly extending from the housing partition wall to the housing first end opening between the housing lid and the housing bottom wall, and the knife assembly having a carriage reciprocally mounted within the housing, with the carriage having a primary knife blade, wherein the carriage is reciprocable within the housing from a first position when the primary knife blade projects through the housing first end opening to a second position wherein the primary knife blade is retracted within the housing, and said lid includes a lid first end spaced from a lid second end, the housing first end having a first end recess, with the lid first end further having a first end rib, wherein the first end rib is arranged in a parallel relationship relative to the housing first end opening, and the rib is received within said first end recess.

2. A utility pen-knife as set forth in claim 1 further including a fastener, and the fastener is directed through the lid spaced from the lid second end, with the fastener received within the partition wall.

3. A utility pen-knife as set forth in claim 2 wherein the carriage includes a carriage floor and carriage side walls, and the primary knife blade is complementarily received within the side walls and positioned upon the carriage floor, wherein the primary knife blade includes a side wall recess, and one of the carriage side walls includes a carriage lug, and the carriage lug is received within the side wall recess.

4. A utility pen-knife as set forth in claim 3 wherein the lid includes a primary slot, and at least a first intersecting slot and a second intersecting slot intersect the primary slot, with a locking lug slidably received within the primary slot, and the locking lug having locking lug shoulders, and the shoulders selectively received within the at least first intersecting slot and the second intersecting slot selectively, and a U-shaped spring, the spring having a first end receiving the locking lug, and the spring having a spring second end, wherein the spring second end is secured to the carriage.

5. A utility pen-knife as set forth in claim 3 wherein the housing further includes a storage cavity oriented between the carriage and the housing bottom wall, and the storage cavity receives a row of secondary knife blades therewithin, and the housing further having spaced parallel carriage tracks, the carriage tracks positioned within the housing and extending laterally of the storage cavity beyond the storage cavity, and the carriage tracks oriented between the storage cavity and the lid.

* * * * *